US009123996B2

(12) United States Patent
Dokai et al.

(10) Patent No.: US 9,123,996 B2
(45) Date of Patent: Sep. 1, 2015

(54) WIRELESS IC DEVICE

(75) Inventors: Yuya Dokai, Nagaokakyo (JP); Nihei Kaishita, Nagaokakyo (JP); Hiroshi Nonogaki, Nagaokakyo (JP); Ryohei Goto, Nagaokakyo (JP); Takahiro Yamaguchi, Nagaokakyo (JP); Kazuyuki Ikeda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 276 days.

(21) Appl. No.: 13/088,480

(22) Filed: Apr. 18, 2011

(65) Prior Publication Data

US 2011/0279326 A1 Nov. 17, 2011

(30) Foreign Application Priority Data

May 14, 2010 (JP) ..... 2010-112676

(51) Int. Cl.

| | |
|---|---|
| ***H01Q 1/38*** | (2006.01) |
| ***H01Q 1/22*** | (2006.01) |
| ***H01Q 7/00*** | (2006.01) |

(52) U.S. Cl.

CPC ..... *H01Q 1/38* (2013.01); *H01Q 1/2225* (2013.01); *H01Q 7/00* (2013.01)

(58) Field of Classification Search

CPC ..... H01Q 1/38
USPC ..... 343/700 MS
See application file for complete search history.

(56) References Cited

U.S. PATENT DOCUMENTS

| | | | |
|---|---|---|---|
| 3,364,564 | A | 1/1968 | Kurtz et al. |
| 4,794,397 | A | 12/1988 | Ohe et al. |
| 5,232,765 | A | 8/1993 | Yano et al. |
| 5,253,969 | A | 10/1993 | Richert |
| 5,337,063 | A | 8/1994 | Takahira |
| 5,374,937 | A | 12/1994 | Tsunekawa et al. |
| 5,399,060 | A | 3/1995 | Richert |
| 5,491,483 | A | 2/1996 | D'Hont |
| 5,528,222 | A | 6/1996 | Moskowitz et al. |
| 5,757,074 | A | 5/1998 | Matloubian et al. |
| 5,854,480 | A | 12/1998 | Noto |
| 5,903,239 | A | 5/1999 | Takahashi et al. |

(Continued)

FOREIGN PATENT DOCUMENTS

| | | | |
|---|---|---|---|
| CN | 101351817 | A | 1/2009 |
| DE | 10 2006 057 369 | A1 | 6/2008 |

(Continued)

OTHER PUBLICATIONS

Musen IC tagu Katsuyo-no Subete (All about Wireless IC Tags 'Nikkei BP Mukku-Sha pp. 112-126 ), Nov. 18, 2005.*

(Continued)

*Primary Examiner* — Sujoy Kundu
*Assistant Examiner* — Steven J Malone
(74) *Attorney, Agent, or Firm* — Keating & Bennett, LLP

(57) ABSTRACT

A wireless IC device includes a substantially rectangular parallelepiped dielectric body, a metal pattern that is provided on the surface of the dielectric body via a film and functions as a radiator, and a wireless IC element coupled to feeding portions of the metal pattern. The dielectric body has a laminated structure including a folded flexible dielectric layer. Surfaces of the dielectric layer which face each other after the dielectric layer has been folded are non-bonded surfaces.

12 Claims, 12 Drawing Sheets

(56) References Cited

U.S. PATENT DOCUMENTS 5,936,150 A 8/1999 Kobrin et al.
5,955,723 A 9/1999 Reiner
5,995,006 A 11/1999 Walsh
6,104,311 A 8/2000 Lastinger
6,107,920 A 8/2000 Eberhardt et al.
6,114,962 A * 9/2000 Wiklof et al. ..... 340/572.8
6,147,604 A * 11/2000 Wiklof et al. ..... 340/572.1
6,165,386 A * 12/2000 Endo et al. ..... 252/500
6,172,608 B1 1/2001 Cole
6,181,287 B1 1/2001 Beigel
6,190,942 B1 2/2001 Wilm et al.
6,249,258 B1 6/2001 Bloch et al.
6,259,369 B1 7/2001 Monico
6,271,803 B1 8/2001 Watanabe et al.
6,278,413 B1 * 8/2001 Hugh et al. ..... 343/818
6,335,686 B1 1/2002 Goff et al.
6,362,784 B1 3/2002 Kane et al.
6,367,143 B1 4/2002 Sugimura
6,378,774 B1 4/2002 Emori et al.
6,406,990 B1 6/2002 Kawai
6,448,874 B1 9/2002 Shiino et al.
6,462,716 B1 10/2002 Kushihi
6,542,050 B1 4/2003 Arai et al.
6,600,459 B2 7/2003 Yokoshima et al.
6,634,564 B2 10/2003 Kuramochi
6,664,645 B2 12/2003 Kawai
6,763,254 B2 7/2004 Nishikawa
6,812,707 B2 11/2004 Yonezawa et al.
6,828,881 B2 12/2004 Mizutani et al.
6,837,438 B1 1/2005 Takasugi et al.
6,861,731 B2 3/2005 Buijsman et al.
6,927,738 B2 8/2005 Senba et al.
6,963,729 B2 11/2005 Uozumi
7,088,249 B2 8/2006 Senba et al.
7,088,307 B2 8/2006 Imaizumi
7,112,952 B2 9/2006 Arai et al.
7,119,693 B1 10/2006 Devilbiss
7,129,834 B2 10/2006 Naruse et al.
7,248,221 B2 7/2007 Kai et al.
7,250,910 B2 7/2007 Yoshikawa et al.
7,276,929 B2 10/2007 Arai et al.
7,317,396 B2 1/2008 Ujino
7,405,664 B2 7/2008 Sakama et al.
8,502,678 B2 * 8/2013 Brown et al. ..... 340/572.7
8,570,173 B2 * 10/2013 Kai et al. ..... 340/572.1
2002/0011967 A1 1/2002 Goff et al.
2002/0015002 A1 2/2002 Yasukawa et al.
2002/0044092 A1 4/2002 Kushihi
2002/0067316 A1 6/2002 Yokoshima et al.
2002/0093457 A1 7/2002 Hamada et al.
2003/0006901 A1 1/2003 Kim et al.
2003/0020661 A1 1/2003 Sato
2003/0045324 A1 3/2003 Nagumo et al.
2003/0169153 A1 9/2003 Muller
2004/0001027 A1 1/2004 Killen et al.
2004/0026519 A1 2/2004 Usami et al.
2004/0056823 A1 3/2004 Zuk et al.
2004/0066617 A1 4/2004 Hirabayashi et al.
2004/0217915 A1 11/2004 Imaizumi
2004/0219956 A1 11/2004 Iwai et al.
2004/0227673 A1 11/2004 Iwai et al.
2004/0252064 A1 12/2004 Yuanzhu
2005/0092836 A1 5/2005 Kudo
2005/0099337 A1 5/2005 Takei et al.
2005/0125093 A1 6/2005 Kikuchi et al.
2005/0134460 A1 6/2005 Usami
2005/0134506 A1 6/2005 Egbert
2005/0138798 A1 6/2005 Sakama et al.
2005/0140512 A1 6/2005 Sakama et al.
2005/0232412 A1 10/2005 Ichihara et al.
2005/0236623 A1 10/2005 Takechi et al.
2005/0275539 A1 12/2005 Sakama et al.
2006/0001138 A1 1/2006 Sakama et al.
2006/0032926 A1 2/2006 Baba et al.
2006/0044192 A1 3/2006 Egbert
2006/0055601 A1 3/2006 Kameda et al.
2006/0071084 A1 4/2006 Detig et al.
2006/0109185 A1 5/2006 Iwai et al.
2006/0145872 A1 7/2006 Tanaka et al.
2006/0158380 A1 7/2006 Son et al.
2006/0170606 A1 8/2006 Yamagajo et al.
2006/0214801 A1 9/2006 Murofushi et al.
2006/0220871 A1 10/2006 Baba et al.
2006/0244676 A1 11/2006 Uesaka
2006/0267138 A1 11/2006 Kobayashi
2007/0004028 A1 1/2007 Lair et al.
2007/0018893 A1 1/2007 Kai et al.
2007/0040028 A1 2/2007 Kawamata
2007/0052613 A1 3/2007 Gallschuetz et al.
2007/0057854 A1 3/2007 Oodachi et al.
2007/0069037 A1 3/2007 Kawai
2007/0132591 A1 6/2007 Khatri
2007/0164414 A1 7/2007 Dokai et al.
2007/0200782 A1 8/2007 Hayama et al.
2007/0229276 A1 10/2007 Yamagajo et al.
2007/0252700 A1 11/2007 Ishihara et al.
2007/0252703 A1 * 11/2007 Kato et al. ..... 340/572.8
2007/0285335 A1 12/2007 Bungo et al.
2007/0290928 A1 12/2007 Chang et al.
2008/0024156 A1 1/2008 Arai et al.
2008/0055045 A1 * 3/2008 Swan et al. ..... 340/10.1
2008/0087990 A1 4/2008 Kato et al.
2008/0169905 A1 7/2008 Slatter
2008/0272885 A1 11/2008 Atherton
2009/0002130 A1 1/2009 Kato
2009/0009007 A1 1/2009 Kato et al.
2009/0021446 A1 * 1/2009 Kataya et al. ..... 343/860
2009/0065594 A1 3/2009 Kato et al.
2009/0109102 A1 4/2009 Dokai et al.
2009/0160653 A1 * 6/2009 Yeh et al. ..... 340/572.7
2009/0160719 A1 6/2009 Kato et al.
2009/0174606 A1 * 7/2009 Qian et al. ..... 343/700 MS
2009/0201116 A1 8/2009 Orihara
2009/0231106 A1 9/2009 Okamura
2009/0262041 A1 10/2009 Ikemoto et al.
2010/0045025 A1 * 2/2010 Cote et al. ..... 283/81
2010/0230497 A1 * 9/2010 Brown et al. ..... 235/488
2011/0063184 A1 * 3/2011 Furumura et al. ..... 343/856

FOREIGN PATENT DOCUMENTS

EP 0 694 874 A2 1/1996
EP 0 977 145 A2 2/2000
EP 1 010 543 A1 6/2000
EP 1 160 915 A2 12/2001
EP 1 170 795 A2 1/2002
EP 1 227 540 A1 7/2002
EP 1 280 232 A1 1/2003
EP 1 280 350 A1 1/2003
EP 1 343 223 A1 9/2003
EP 1 357 511 A2 10/2003
EP 1 548 872 A1 6/2005
EP 1 703 589 A1 9/2006
EP 1 744 398 A1 1/2007
EP 1 841 005 A1 10/2007
EP 1 865 574 A1 12/2007
EP 1 976 056 A1 10/2008
EP 1 993 170 A1 11/2008
EP 2 009 738 A1 12/2008
EP 2 012 258 A1 1/2009
EP 2 148 449 A1 1/2010
EP 2 251 934 A1 11/2010
GB 2 305 075 A 3/1997
JP 50-143451 A 11/1975
JP 62-127140 U 8/1987
JP 02-164105 A 6/1990
JP 03-262313 A 11/1991
JP 04-150011 A 5/1992
JP 04-167500 A 6/1992
JP 05-206716 A 8/1993
JP 05-327331 A 12/1993
JP 6-53733 A 2/1994
JP 06-077729 A 3/1994
JP 06-177635 A 6/1994

(56) References Cited

FOREIGN PATENT DOCUMENTS

| | | | |
|---|---|---|---|
| JP | 6-260949 | A | 9/1994 |
| JP | 07-183836 | A | 7/1995 |
| JP | 08-056113 | A | 2/1996 |
| JP | 8-87580 | A | 4/1996 |
| JP | 08-088586 | A | 4/1996 |
| JP | 11-149537 | A | 6/1996 |
| JP | 08-176421 | A | 7/1996 |
| JP | 08-180160 | A | 7/1996 |
| JP | 08-279027 | A | 10/1996 |
| JP | 08-307126 | A | 11/1996 |
| JP | 08-330372 | A | 12/1996 |
| JP | 09-014150 | A | 1/1997 |
| JP | 09-035025 | A | 2/1997 |
| JP | 9-93029 | A | 4/1997 |
| JP | 09-245381 | A | 9/1997 |
| JP | 09-252217 | A | 9/1997 |
| JP | 09-270623 | A | 10/1997 |
| JP | 9-512367 | A | 12/1997 |
| JP | 10-069533 | A | 3/1998 |
| JP | 10-69533 | A | 3/1998 |
| JP | 10-505466 | A | 5/1998 |
| JP | 10-171954 | A | 6/1998 |
| JP | 10-193849 | A | 7/1998 |
| JP | 10-193851 | A | 7/1998 |
| JP | 11-219420 | A | 8/1998 |
| JP | 10-293828 | A | 11/1998 |
| JP | 11-039441 | A | 2/1999 |
| JP | 11-075329 | A | 3/1999 |
| JP | 11-085937 | A | 3/1999 |
| JP | 11-88241 | A | 3/1999 |
| JP | 11-102424 | A | 4/1999 |
| JP | 11-103209 | A | 4/1999 |
| JP | 11-149536 | A | 6/1999 |
| JP | 11-149538 | A | 6/1999 |
| JP | 11-220319 | A | 8/1999 |
| JP | 11-328352 | A | 11/1999 |
| JP | 11-346114 | A | 12/1999 |
| JP | 11-515094 | A | 12/1999 |
| JP | 2000-21128 | A | 1/2000 |
| JP | 2000-021639 | A | 1/2000 |
| JP | 2000-022421 | A | 1/2000 |
| JP | 2005-229474 | A | 1/2000 |
| JP | 2000-059260 | A | 2/2000 |
| JP | 2000-085283 | A | 3/2000 |
| JP | 2000-090207 | A | 3/2000 |
| JP | 2000-132643 | A | 5/2000 |
| JP | 2000-137778 | A | 5/2000 |
| JP | 2000-137779 | A | 5/2000 |
| JP | 2000-137785 | A | 5/2000 |
| JP | 2000-148948 | A | 5/2000 |
| JP | 2000-172812 | A | 6/2000 |
| JP | 2000-209013 | A | 7/2000 |
| JP | 2000-222540 | A | 8/2000 |
| JP | 2000-510271 | A | 8/2000 |
| JP | 2000-242754 | A | 9/2000 |
| JP | 2000-243797 | A | 9/2000 |
| JP | 2000-251049 | A | 9/2000 |
| JP | 2000-261230 | A | 9/2000 |
| JP | 2000-276569 | A | 10/2000 |
| JP | 2000-286634 | A | 10/2000 |
| JP | 2000-286760 | A | 10/2000 |
| JP | 2000-311226 | A | 11/2000 |
| JP | 2000-321984 | A | 11/2000 |
| JP | 3075400 | U | 11/2000 |
| JP | 2000-349680 | A | 12/2000 |
| JP | 2001-10264 | A | 1/2001 |
| JP | 2001-028036 | A | 1/2001 |
| JP | 2007-18067 | A | 1/2001 |
| JP | 2001-043340 | A | 2/2001 |
| JP | 2001-66990 | A | 3/2001 |
| JP | 2001-76111 | A | 3/2001 |
| JP | 2001-505682 | A | 4/2001 |
| JP | 2001-168628 | A | 6/2001 |
| JP | 2001-188890 | A | 7/2001 |
| JP | 2001-240046 | A | 9/2001 |
| JP | 2001-256457 | A | 9/2001 |
| JP | 2001-257292 | A | 9/2001 |
| JP | 2001-514777 | A | 9/2001 |
| JP | 2001-319380 | A | 11/2001 |
| JP | 2001-331976 | A | 11/2001 |
| JP | 2001-332923 | A | 11/2001 |
| JP | 2001-339226 | A | 12/2001 |
| JP | 2001-344574 | A | 12/2001 |
| JP | 2001-351084 | A | 12/2001 |
| JP | 2001-352176 | A | 12/2001 |
| JP | 2002-024776 | A | 1/2002 |
| JP | 2002-026513 | A | 1/2002 |
| JP | 2002-32731 | A | 1/2002 |
| JP | 2002-042076 | A | 2/2002 |
| JP | 2002-063557 | A | 2/2002 |
| JP | 2002-505645 | A | 2/2002 |
| JP | 2002-076750 | A | 3/2002 |
| JP | 2002-76750 | A | 3/2002 |
| JP | 2002-150245 | A | 5/2002 |
| JP | 2002-157564 | A | 5/2002 |
| JP | 2002-158529 | A | 5/2002 |
| JP | 2002-175508 | A | 6/2002 |
| JP | 2002-183690 | A | 6/2002 |
| JP | 2002-185358 | A | 6/2002 |
| JP | 2002-204117 | A | 7/2002 |
| JP | 2002-522849 | A | 7/2002 |
| JP | 2002-230128 | A | 8/2002 |
| JP | 2002-232221 | A | 8/2002 |
| JP | 2002-252117 | A | 9/2002 |
| JP | 2002-259934 | A | 9/2002 |
| JP | 2002-280821 | A | 9/2002 |
| JP | 2002-298109 | A | 10/2002 |
| JP | 2002-308437 | A | 10/2002 |
| JP | 2002-319008 | A | 10/2002 |
| JP | 2002-319009 | A | 10/2002 |
| JP | 2002-319812 | A | 10/2002 |
| JP | 2002-362613 | A | 12/2002 |
| JP | 2002-366917 | A | 12/2002 |
| JP | 2002-373029 | A | 12/2002 |
| JP | 2002-373323 | A | 12/2002 |
| JP | 2002-374139 | A | 12/2002 |
| JP | 2003-006599 | A | 1/2003 |
| JP | 2003-016412 | A | 1/2003 |
| JP | 2003-026177 | A | 1/2003 |
| JP | 2003-030612 | A | 1/2003 |
| JP | 2003-44789 | A | 2/2003 |
| JP | 2003-046318 | A | 2/2003 |
| JP | 2003-58840 | A | 2/2003 |
| JP | 2003-067711 | A | 3/2003 |
| JP | 2003-069335 | A | 3/2003 |
| JP | 2003-076947 | A | 3/2003 |
| JP | 2003-76963 | A | 3/2003 |
| JP | 2003-78333 | A | 3/2003 |
| JP | 2003-078336 | A | 3/2003 |
| JP | 2003-085501 | A | 3/2003 |
| JP | 2003-085520 | A | 3/2003 |
| JP | 2003-87008 | A | 3/2003 |
| JP | 2003-87044 | A | 3/2003 |
| JP | 2003-099720 | A | 4/2003 |
| JP | 2003-099721 | A | 4/2003 |
| JP | 2003-110344 | A | 4/2003 |
| JP | 2003-132330 | A | 5/2003 |
| JP | 2003-134007 | A | 5/2003 |
| JP | 2003-155062 | A | 5/2003 |
| JP | 2003-158414 | A | 5/2003 |
| JP | 2003-168760 | A | 6/2003 |
| JP | 2003-179565 | A | 6/2003 |
| JP | 2003-187207 | A | 7/2003 |
| JP | 2003-187211 | A | 7/2003 |
| JP | 2003-188338 | A | 7/2003 |
| JP | 2003-188620 | A | 7/2003 |
| JP | 2003-198230 | A | 7/2003 |
| JP | 2003-209421 | A | 7/2003 |
| JP | 2003-216919 | A | 7/2003 |
| JP | 2003-218624 | A | 7/2003 |
| JP | 2003-233780 | A | 8/2003 |
| JP | 2003-242471 | A | 8/2003 |
| JP | 2003-243918 | A | 8/2003 |
| JP | 2003-249813 | A | 9/2003 |

(56) References Cited

FOREIGN PATENT DOCUMENTS

| | | | |
|---|---|---|---|
| JP | 2003-529163 | A | 9/2003 |
| JP | 2003-288560 | A | 10/2003 |
| JP | 2003-309418 | A | 10/2003 |
| JP | 2003-317060 | A | 11/2003 |
| JP | 2003-331246 | A | 11/2003 |
| JP | 2003-332820 | A | 11/2003 |
| JP | 2003-536302 | A | 12/2003 |
| JP | 2004-040597 | A | 2/2004 |
| JP | 2004-505481 | A | 2/2004 |
| JP | 2004-082775 | A | 3/2004 |
| JP | 2004-88218 | A | 3/2004 |
| JP | 2004-93693 | A | 3/2004 |
| JP | 2004-096566 | A | 3/2004 |
| JP | 2004-127230 | A | 4/2004 |
| JP | 2004-213582 | A | 7/2004 |
| JP | 2004-519916 | A | 7/2004 |
| JP | 2004-234595 | A | 8/2004 |
| JP | 2004-253858 | A | 9/2004 |
| JP | 2004-527864 | A | 9/2004 |
| JP | 2004-280390 | A | 10/2004 |
| JP | 2004-287767 | A | 10/2004 |
| JP | 2004-297249 | A | 10/2004 |
| JP | 2004-297681 | A | 10/2004 |
| JP | 2004-304370 | A | 10/2004 |
| JP | 2004-319848 | A | 11/2004 |
| JP | 2004-326380 | A | 11/2004 |
| JP | 2004-334268 | A | 11/2004 |
| JP | 2004-336250 | A | 11/2004 |
| JP | 2004-343000 | A | 12/2004 |
| JP | 2004-362190 | A | 12/2004 |
| JP | 2004-362341 | A | 12/2004 |
| JP | 2004-362602 | A | 12/2004 |
| JP | 2005-5866 | A | 1/2005 |
| JP | 2005-18156 | A | 1/2005 |
| JP | 2005-124061 | A | 5/2005 |
| JP | 2005-128592 | A | 5/2005 |
| JP | 2005-129019 | A | 5/2005 |
| JP | 2005-135132 | A | 5/2005 |
| JP | 2005-136528 | A | 5/2005 |
| JP | 2005-137032 | A | 5/2005 |
| JP | 3653099 | B2 | 5/2005 |
| JP | 2005-165839 | A | 6/2005 |
| JP | 2005-167327 | A | 6/2005 |
| JP | 2005-167813 | A | 6/2005 |
| JP | 2005-190417 | A | 7/2005 |
| JP | 2005-191705 | A | 7/2005 |
| JP | 2005-210676 | A | 8/2005 |
| JP | 2005-210680 | A | 8/2005 |
| JP | 2005-217822 | A | 8/2005 |
| JP | 2005-236339 | A | 9/2005 |
| JP | 2005-244778 | A | 9/2005 |
| JP | 2005-252853 | A | 9/2005 |
| JP | 2005-275870 | A | 10/2005 |
| JP | 2005-284352 | A | 10/2005 |
| JP | 2005-293537 | A | 10/2005 |
| JP | 2005-295135 | A | 10/2005 |
| JP | 2005-311205 | A | 11/2005 |
| JP | 2005-321305 | A | 11/2005 |
| JP | 2005-322119 | A | 11/2005 |
| JP | 2005-335755 | A | 12/2005 |
| JP | 2005-340759 | A | 12/2005 |
| JP | 2005-345802 | A | 12/2005 |
| JP | 2005-346820 | A | 12/2005 |
| JP | 2005-352858 | A | 12/2005 |
| JP | 2006-13976 | A | 1/2006 |
| JP | 2006-025390 | A | 1/2006 |
| JP | 2006-031766 | A | 2/2006 |
| JP | 2006-39902 | A | 2/2006 |
| JP | 2006-42059 | A | 2/2006 |
| JP | 2006-42097 | A | 2/2006 |
| JP | 2006-053833 | A | 2/2006 |
| JP | 2006-67479 | A | 3/2006 |
| JP | 2006-72706 | A | 3/2006 |
| JP | 2006-80367 | A | 3/2006 |
| JP | 2006-92630 | A | 4/2006 |
| JP | 2006-102953 | A | 4/2006 |
| JP | 2006-107296 | A | 4/2006 |
| JP | 2006-513594 | A | 4/2006 |
| JP | 2006-148462 | A | 6/2006 |
| JP | 2006-148518 | A | 6/2006 |
| JP | 2006-151402 | A | 6/2006 |
| JP | 2006-174151 | A | 6/2006 |
| JP | 2006-195795 | A | 7/2006 |
| JP | 2006-203187 | A | 8/2006 |
| JP | 2006-203852 | A | 8/2006 |
| JP | 2006-217000 | A | 8/2006 |
| JP | 2006-232292 | A | 9/2006 |
| JP | 2006-237674 | A | 9/2006 |
| JP | 2006-270212 | A | 10/2006 |
| JP | 2006-270766 | A | 10/2006 |
| JP | 2006-285911 | A | 10/2006 |
| JP | 2006-295879 | A | 10/2006 |
| JP | 2006-302219 | A | 11/2006 |
| JP | 2006-309401 | A | 11/2006 |
| JP | 2006-311239 | A | 11/2006 |
| JP | 2006-323481 | A | 11/2006 |
| JP | 2006-339964 | A | 12/2006 |
| JP | 2007-007888 | A | 1/2007 |
| JP | 2007-13120 | A | 1/2007 |
| JP | 2007-28002 | A | 2/2007 |
| JP | 2007-043535 | A | 2/2007 |
| JP | 2007-048126 | A | 2/2007 |
| JP | 2007-65822 | A | 3/2007 |
| JP | 2007-79687 | A | 3/2007 |
| JP | 2007-81712 | A | 3/2007 |
| JP | 2007-096768 | A | 4/2007 |
| JP | 2007-102348 | A | 4/2007 |
| JP | 2007-122542 | A | 5/2007 |
| JP | 2007-150642 | A | 6/2007 |
| JP | 2007-150868 | A | 6/2007 |
| JP | 2007-159083 | A | 6/2007 |
| JP | 2007-159129 | A | 6/2007 |
| JP | 2007-172369 | A | 7/2007 |
| JP | 2007-172527 | A | 7/2007 |
| JP | 2007-228325 | A | 9/2007 |
| JP | 2007-266999 | A | 10/2007 |
| JP | 2007-272264 | A | 10/2007 |
| JP | 2007-287128 | A | 11/2007 |
| JP | 2007-312350 | A | 11/2007 |
| JP | 2007-324865 | A | 12/2007 |
| JP | 2008-033716 | A | 2/2008 |
| JP | 2008-042379 | A | 2/2008 |
| JP | 2008-72243 | A | 3/2008 |
| JP | 4069958 | B2 | 4/2008 |
| JP | 2008-107947 | A | 5/2008 |
| JP | 2008-148345 | A | 6/2008 |
| JP | 2008-519347 | A | 6/2008 |
| JP | 2008-160874 | A | 7/2008 |
| JP | 11-175678 | A | 1/2009 |
| JP | 2009-25870 | A | 2/2009 |
| JP | 2009-27291 | A | 2/2009 |
| JP | 2009-044715 | A | 2/2009 |
| JP | 2009-253104 | A | 10/2009 |
| JP | 2010279029 | A * | 12/2010 |
| NL | 9100176 | A | 3/1992 |
| NL | 9100347 | A | 3/1992 |
| WO | 99/67754 | A1 | 12/1999 |
| WO | 00/10122 | A2 | 2/2000 |
| WO | 01/95242 | A2 | 12/2001 |
| WO | 02/061675 | A1 | 8/2002 |
| WO | 02/097723 | A1 | 12/2002 |
| WO | 03/079305 | A1 | 9/2003 |
| WO | 2004/036772 | A1 | 4/2004 |
| WO | 2004/070879 | A | 8/2004 |
| WO | 2004/072892 | A1 | 8/2004 |
| WO | 2005/073937 | A | 8/2005 |
| WO | 2005/091434 | A1 | 9/2005 |
| WO | 2005/115849 | A1 | 12/2005 |
| WO | 2006/045682 | A | 5/2006 |
| WO | 2006/048663 | A1 | 5/2006 |
| WO | 2006/114821 | A1 | 11/2006 |
| WO | 2007/083574 | A1 | 7/2007 |
| WO | 2007/083575 | A1 | 7/2007 |
| WO | 20071083574 | A1 | 7/2007 |

(56) References Cited

FOREIGN PATENT DOCUMENTS

| | | | |
|---|---|---|---|
| WO | 2007/086130 | A1 | 8/2007 |
| WO | 2007/102360 | A1 | 9/2007 |
| WO | 2007/119310 | A1 | 10/2007 |
| WO | 2007/125683 | A1 | 11/2007 |
| WO | 2007/138857 | A1 | 12/2007 |
| WO | 2008/007606 | A | 1/2008 |
| WO | 2008/140037 | A1 | 11/2008 |
| WO | 2009/011376 | A1 | 1/2009 |
| WO | 2009/081719 | A1 | 7/2009 |
| WO | 2009/110381 | A1 | 9/2009 |
| WO | WO 2012157596 | A1 * | 11/2012 |

OTHER PUBLICATIONS

Official communication issued in counterpart European Application No. 08 77 7758, dated on Jun. 30, 2009.
Official communication issued in counterpart Japanese Application No. 2008-103741, mailed on May 26, 2009.
Official communication issued in counterpart Japanese Application No. 2008-103742, mailed on May 26, 2009.
Official communication issued in International Application No. PCT/JP2008/050358, mailed on Mar. 25, 2008.
Official communications issued in International Application No. PCT/JP2008/050356, mailed on Mar. 25, 2008.
Osamura et al.: "Packaging Material With Electromagnetic Coupling Module,"; U.S. Appl. No. 12/536,663, filed Aug. 6, 2009.
Osamura et al.: "Packaging Material With Electromagnetic Coupling Module,"; U.S. Appl. No. 12/536,669, filed Aug. 6, 2009.
Dokai et al.: "Wireless IC Device and Component for Wireless IC Device,"; U.S. Appl. No. 12/543,553, filed Aug. 19, 2009.
Shioya et al.: "Wireless IC Device,"; U.S. Appl. No. 12/551,037, filed Aug. 31, 2009.
Ikemoto: "Wireless IC Device and Manufacturing Method Thereof,"; U.S. Appl. No. 12/579,672, filed Oct. 15, 2009.
Official communication issued in International Application No. PCT/JP2008/058614, mailed on Jun. 10, 2008.
Official Communication issued in corresponding Japanese Patent Application No. 2010-112676, mailed on Jul. 24, 2012.
Official Communication issued in International Patent Application No. PCT/JP2009/069486, mailed on Mar. 2, 2010.
Kato: "Radio IC Device"; U.S. Appl. No. 13/080,775, filed Apr. 6, 2011.
Kato et al.: "Antenna and Wireless IC Device"; U.S. Appl. No. 13/083,626, filed Apr. 11, 2011.
Official communication issued in counterpart International Application No. PCT/JP2008/071502, mailed Feb. 24, 2009.
Kato et al.: "Wireless IC Device and Manufacturing Method Thereof,"; U.S. Appl. No. 12/432,854, filed Apr. 30, 2009.
Official communication issued in counterpart International Application No. PCT/JP2008/058168, mailed Aug. 12, 2008.
Official communication issued in counterpart International Application No. PCT/JP2008/062886, mailed Oct. 21, 2008.
Kato et al.: "Wireless IC Device,"; U.S. Appl. No. 12/469,896, filed May 21, 2009.
Ikemoto et al.: "Wireless IC Device,"; U.S. Appl. No. 12/496,709, filed Jul. 2, 2009.
Official communication issued in counterpart International Application No. PCT/JP2008/062947, mailed Aug. 19, 2008.
Official communication issued in counterpart International Application No. PCT/JP2008/056026, mailed Jul. 1, 2008.
Ikemoto et al., "Wireless IC Device and Electronic Apparatus,"; U.S. Appl. No. 12/503,188, filed Jul. 15, 2009.
Official communication issued in counterpart International Application No. PCT/JP2008/055567, mailed May 20, 2008.
Official communication issued in counterpart International Application No. PCT/JP2008/051853, mailed Apr. 22, 2008.
Official communication issued in counterpart International Application No. PCT/JP2008/057239, mailed Jul. 22, 2008.
Kimura et al.: "Wireless IC Device,"; U.S. Appl. No. 12/510,338, filed Jul. 28, 2009.
Kato et al.: "Wireless IC Device,"; U.S. Appl. No. 12/510,340, filed Jul. 28, 2009.
Kato: "Wireless IC Device,"; U.S. Appl. No. 12/510,344, filed Jul. 28, 2009.
Kato et al.: "Wireless IC Device,"; U.S. Appl. No. 12/510,347, filed Jul. 28, 2009.
Official Communication issued in International Application No. PCT/JP2007/066007, mailed on Nov. 27, 2007.
Dokai et al.: "Wireless IC Device and Component for Wireless IC Device"; U.S. Appl. No. 12/359,690, filed Jan. 26, 2009.
Dokai et al.: "Test System for Radio Frequenct IC Devices and Method of Manufacturing Radio Frequency IC Devices Using the Same"; U.S. Appl. No. 12/388,826, filed Feb. 19, 2009.
Official Communication issued in International Application No. PCT/JP2008/061955, mailed on Sep. 30, 2008.
Official Communication issued in International Application No. PCT/JP2007/066721, mailed on Nov. 27, 2007.
Official Communication issued in International Application No. PCT/JP2007/070460, mailed on Dec. 11, 2007.
Kato et al.: "Wireless IC Device"; U.S. Appl. No. 12/390,556, filed Feb. 23, 2009.
Kato et al.: "Inductively Coupled Module and Item With Inductively Coupled Module"; U.S. Appl. No. 12/398,497 filed Mar. 5, 2009.
Official Communication issued in International Patent Application No. PCT/JP2008/050945, mailed on May 1, 2008.
Kato et al.: "Article Having Electromagnetic Coupling Module Attached Thereto"; U.S. Appl. No. 12/401,767; filed Mar. 11, 2009.
Taniguchi et al.: "Antenna Device and Radio Frequency IC Device"; U.S. Appl. No. 12/326,117, filed Dec. 2, 2008.
Official Communication issued in International Patent Application No. PCT/JP2008/061442, mailed on Jul. 22, 2008.
Kato et al.: "Container With Electromagnetic Coupling Module"; U.S. Appl. No. 12/426,369, filed Apr. 20, 2009.
Kato: "Wireless IC Device"; U.S. Appl. No. 12/429,346, filed Apr. 24, 2009.
Official Communication issued in International Patent Application No. PCT/JP2009/056934, mailed on Jun. 30, 2009.
Kato et al.: "Wireless IC Device"; U.S. Appl. No. 12/903,242, filed Oct. 13, 2010.
Kato et al.: "Wireless IC Device"; U.S. Appl. No. 12/940,103, filed Nov. 5, 2010.
Kato et al.: "Wireless IC Device System and Method of Determining Authenticity of Wireless IC Device"; U.S. Appl. No. 12/940,105, filed Nov. 5, 2010.
Official Communication issued in International Patent Application No. PCT/JP2009/059669, mailed on Aug. 25, 2009.
Official Communication issued in International Patent Application No. PCT/JP2009/062181, mailed on Oct. 13, 2009.
Official Communication issued in corresponding Japanese Application No. 2010-501323, mailed on Apr. 6, 2010.
Kato et al.: "Component of Wireless IC Device and Wireless IC Device"; U.S. Appl. No. 12/944,099, filed Nov. 11, 2010.
Kato et al.: Wireless IC Device and Manufacturing Method Thereof; U.S. Appl. No. 12/961,599, filed Dec. 7, 2010.
Kataya et al.: "Radio Frequency IC Device and Electronic Apparatus"; U.S. Appl. No. 12/959,454, filed Dec. 3, 2010.
Ikemoto et al.:"Radio IC Device"; U.S. Appl. No. 12/981,582, filed Dec. 30, 2010.
Official Communication issued in International Patent Application No. PCT/JP2009/062801, mailed on Oct. 27, 2009.
Ikemoto et al.: "Wireless IC Device and Electronic Apparatus"; U.S. Appl. No. 13/022,695, filed Feb. 8, 2011.
Official Communication issued in International Patent Application No. PCT/JP2009/067778, mailed on Jan. 26, 2010.
Kato: "Wireless IC Device and Method for Manufacturing Same"; U.S. Appl. No. 13/022,693, filed Feb. 8, 2011.
Kato: "Wireless IC Device"; U.S. Appl. No. 13/080,781, filed Apr. 6, 2011.
English translation of NL9100176, published on Mar. 2, 1992.
English translation of NL9100347, published on Mar. 2, 1992.
Kato et al.: "Antenna"; U.S. Appl. No. 11/928,502, filed Oct. 30, 2007.

(56) References Cited

OTHER PUBLICATIONS

Kato et al.: "Wireless IC Device"; U.S. Appl. No. 12/211,117, filed Sep. 16, 2008.
Kato et al.: "Antenna"; U.S. Appl. No. 11/688,290, filed Mar. 20, 2007.
Kato et al.: "Electromagnetic-Coupling-Module-Attached Article"; U.S. Appl. No. 11/740,509, filed Apr. 26, 2007.
Kato et al.: "Product Including Power Supply Circuit Board"; U.S. Appl. No. 12/234,949, filed Sep. 22, 2008.
Kato et al.: "Data Coupler"; U.S. Appl. No. 12/252,475, filed Oct. 16, 2008.
Kato et al.; "Information Terminal Device"; U.S. Appl. No. 12/267,666, filed Nov. 10, 2008.
Kato et al.: "Wireless IC Device and Wireless IC Device Composite Component"; U.S. Appl. No. 12/276,444, filed Nov. 24, 2008.
Dokai et al.: "Optical Disc"; U.S. Appl. No. 12/326,916, filed Dec. 3, 2008.
Dokai et al.: "System for Inspecting Electromagnetic Coupling Modules and Radio IC Devices and Method for Manufacturing Electromagnetic Coupling Modules and Radio IC Devices Using the System"; U.S. Appl. No. 12/274,400, filed Nov. 20, 2008.
Kato: "Wireless IC Device"; U.S. Appl. No. 11/964,185, filed Dec. 26, 2007.
Kato et al.: "Radio Frequency IC Device"; U.S. Appl. No. 12/336,629, filed Dec. 17, 2008.
Kato et al.: "Wireless IC Device and Component for Wireless IC Device"; U.S. Appl. No. 12/339,198, filed Dec. 19, 2008.
Ikemoto et al.: "Wireless IC Device"; U.S. Appl. No. 11/851,651, filed Sep. 7, 2007.
Kataya et al.: "Wireless IC Device and Electronic Device"; U.S. Appl. No. 11/851,661, filed Sep. 7, 2007.
Dokai et al.: "Antenna and Radio IC Device"; U.S. Appl. No. 12/350,307, filed Jan. 8, 2009.
Official Communication issued in International Patent Application No. PCT/JP2008/063025, mailed on Aug. 12, 2008.
Kato et al.: "Wireless IC Device,"; U.S. Appl. No. 12/603,608, filed Oct. 22, 2009.
Kato et al.: "Wireless IC Device,"; U.S. Appl. No. 12/688,072, filed Jan. 15, 2010.
Official Communication issued in International Patent Application No. PCT/JP2009/053693, mailed on Jun. 9, 2009.
Kato: "Composite Antenna,"; U.S. Appl. No. 12/845,846, filed Jul. 29, 2010.
Official Communication issued in International Patent Application No. PCT/JP2009/053690, mailed on Jun. 2, 2009.
Kato et al.: "Radio Frequency IC Device and Radio Communication System,"; U.S. Appl. No. 12/859,340, filed Aug. 19, 2010.
Official Communication issued in International Patent Application No. PCT/JP2009/055758, mailed on Jun. 23, 2009.
Kato et al.: "Wireless IC Device,"; U.S. Appl. No. 12/859,880, filed Aug. 20, 2010.
Official Communication issued in International Patent Application No. PCT/JP2009/057482, mailed on Jul. 21, 2009.
Kataya et al.: "Wireless IC Device, Electronic Apparatus, and Method for Adjusting Resonant Frequency of Wireless IC Device,"; U.S. Appl. No. 12/861,945, filed Aug. 24, 2010.
Kato: "Wireless IC Device and Electromagnetic Coupling Module,"; U.S. Appl. No. 12/890,895, filed Sep. 27, 2010.
Official Communication issued in International Patent Application No. PCT/JP2009/059410, mailed on Aug. 4, 2009.
Kato et al.: "Wireless IC Device"; U.S. Appl. No. 12/902,174, filed Oct. 12, 2010.
Official Communication issued in International Patent Application No. PCT/JP2009/059259, mailed on Aug. 11, 2009.
Official Communication issued in corresponding Japanese Patent Application No. 2010-506742, mailed on Apr. 6, 2010.
Official Communication issued in International Patent Application No. PCT/JP20091056698, mailed on Jul. 7, 2009.
Official Communication issued in corresponding Chinese Patent Application No. 201110127684.8, mailed on Apr. 30, 2014.
Official communication issued in Japanese Application No. 2007-531524, mailed on Sep. 11, 2007.
Official communication issued in Japanese Application No. 2007-531525, mailed on Sep. 25, 2007.
Official communication issued in Japanese Application No. 2007-531524, mailed on Dec. 12, 2007.
Official communication issued in European Application No. 07706650.4, mailed on Nov. 24, 2008.
Mukku-Sha, "Musen IC Tagu Katsuyo-no Subete" "(All About Wireless IC Tags"), RFID, pp. 112-126, Published Nov. 18, 2005.
Dokai et al.: "Wireless IC Device and Component for Wireless IC Device"; U.S. Appl. No. 11/624,382, filed Jan. 18, 2007.
Dokai et al.: "Wireless IC Device, and Component for Wireless IC Device"; U.S. Appl. No. 11/930,818, filed Oct. 31, 2007.
Kato et al.: "Wireless IC Device"; U.S. Appl. No. 12/042,399, filed Mar. 5, 2008.
Official communication issued in related U.S. Appl. No. 12/042,399; mailed on Aug. 25, 2008.

* cited by examiner

WIRELESS IC DEVICE

BACKGROUND OF THE INVENTION

1. Field of the Invention

The present invention relates to wireless IC devices and, more particularly, to a wireless IC device for use in a Radio Frequency Identification (RFID) system.

2. Description of the Related Art

In recent years, as information management systems for products, RFID systems have been used in which transmission of predetermined information is performed in a non-contact manner between a reader/writer which generates an induction field and an RFID tag (hereinafter also referred to as a wireless IC device) attached to a product. The RFID tag includes a wireless IC chip which stores predetermined information and processes a predetermined radio signal and an antenna (radiator) arranged to transmit/receive a high-frequency signal, and is attached to various management target products (or packages of these products).

Japanese Unexamined Patent Application Publication No. 2007-272264 discloses this type of RFID tag obtained by forming a loop antenna on an insulating film, disposing a wireless IC chip on a portion of the loop antenna, and wrapping the insulating film around a dielectric member.

Products to which such RFID tags are attached have various shapes. For example, a gas cylinder has a curved surface, and it is required that an RFID tag can also be attached to the curved surface. When the RFID tag disclosed in Japanese Unexamined Patent Application Publication No. 2007-272264 includes a dielectric member made of a material such as silicon, the RFID tag can be attached to a curved surface. However, if an RFID tag is attached to a curved surface using only the flexibility of a material, stress concentration may occur between a dielectric member and a loop antenna when the dielectric member is bent. As a result, the loop antenna may be detached from the dielectric member, or a crack may be produced at the dielectric member. Alternatively, the loop antenna may be distorted, a communication characteristic may be changed, and communication reliability may be reduced.

SUMMARY OF THE INVENTION

To overcome the problems described above, preferred embodiments of the present invention provide a wireless IC device capable of preventing detachment of a radiator from a body and preventing a change in a communication characteristic even if the wireless IC device is attached to a curved surface.

A wireless IC device according to a preferred embodiment of the present invention preferably includes a dielectric body including an upper surface and a lower surface, a radiator provided on a surface of the dielectric body, and a wireless IC element coupled to a feeding portion of the radiator. The radiator is preferably a metal pattern that is flexible, for example. The dielectric body preferably has a laminated structure including a plurality of dielectric layers that are flexible, and adjacent ones of the plurality of dielectric layers in a lamination direction preferably include non-bonded surfaces.

A wireless IC device according to another preferred embodiment of the present invention preferably includes a dielectric body including an upper surface and a lower surface, a radiator provided on a surface of the dielectric body, a wireless IC element coupled to a feeding portion of the radiator, and a protection member arranged to cover the dielectric body, the radiator, and the wireless IC element. The radiator is preferably a metal pattern that is flexible. The dielectric body preferably has a laminated structure including a plurality of dielectric layers that are flexible, and adjacent ones of the plurality of dielectric layers in a lamination direction preferably include non-bonded surfaces. Preferably, the dielectric body is covered by the protection member, is sealed by a film, and is attached to a surface of a metal body via the film.

In the wireless IC device, preferably, the radiator is a metal pattern that is flexible, the dielectric body includes a plurality of laminated dielectric layers that are flexible, and these dielectric layers include non-bonded surfaces. Accordingly, even if the wireless IC device is attached to the curved surface of a product (metal body), the dielectric body and the radiator follow the curved surface and stress concentration between the dielectric body and the radiator does not occur. As a result, a change in a communication characteristic caused by the detachment of the radiator from the dielectric body and the distortion of the radiator is prevented, and communication reliability is not reduced. By attaching the wireless IC device to the metal body, the metal body functions as a radiating element and a communication distance is increased.

According to preferred embodiments of the present invention, it is possible to prevent detachment of a radiator from a body and prevent a change in a communication characteristic even if a wireless IC device is attached to a curved surface.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
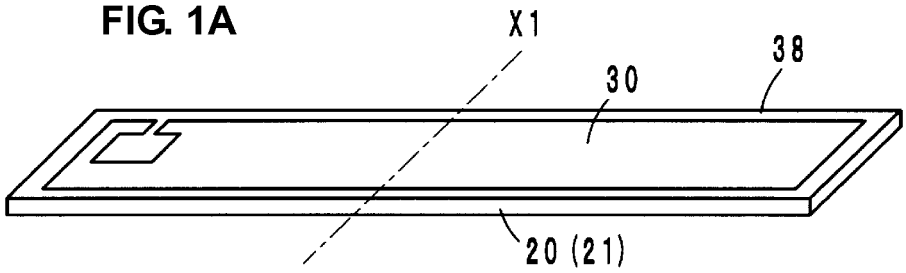
FIG. 1A is a perspective view of a dielectric body in a wireless IC device according to a first preferred embodiment of the present invention.

A wireless IC device according to preferred embodiments of the present invention will be described below with reference to the accompanying drawings. In the drawings, the same reference numeral is used to represent the same component or the same portion so as to avoid repeated explanation.

First Preferred Embodiment

A wireless IC device 10A according to the first preferred embodiment of the present invention is preferably used for communication in a UHF band, and preferably includes a substantially rectangular parallelepiped dielectric body 20, a metal pattern 30 defining a radiator, a flexible resin film 38 on which the metal pattern 30 is provided, and a wireless IC element 50 as illustrated in FIGS. 1A to 1D.

The dielectric body 20 preferably includes a dielectric layer 21 made of a fluorocarbon resin or a urethane resin, for example. The dielectric layer 21 may also be an insulating magnetic substance, for example. As illustrated in FIG. 1A, the dielectric body 20 is preferably a single long strip. The dielectric layer 21 is flexible in the thickness direction thereof. The metal pattern 30 is preferably made of a conductive material such as a copper foil or an aluminum foil, for example, that is flexible, and is attached to the flexible resin film 38 via an adhesive. The flexible resin film 38 may preferably be a double-sided tape, for example.

Figure 1B:
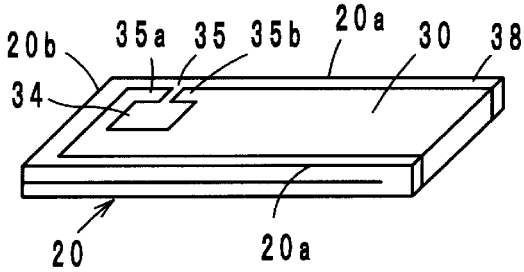
FIG. 1B is a perspective view of the folded dielectric body.
Figure 1C:
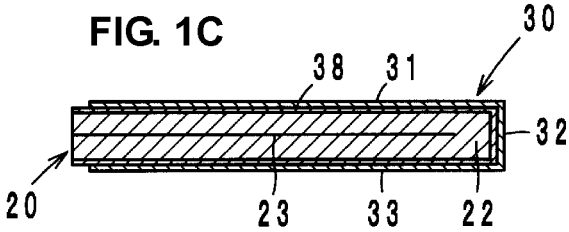
FIG. 1C is a cross-sectional view of the folded dielectric body.

The flexible resin film 38 on which the metal pattern 30 is provided is attached to the upper surface of the dielectric layer 21, and the dielectric layer 21 is folded along a substantially center line (a line X1) so that a first half and a second half of the lower surface of the dielectric layer 21 face each other (see, FIGS. 1A and 1B). As a result, the dielectric body 20 preferably having a laminated structure and a substantially rectangular parallelepiped shape is obtained. The metal pattern 30 extends from an upper surface to a lower surface through a side surface of the dielectric body 20, and includes an upper electrode 31, a side electrode 32, and a lower electrode 33 (see, FIG. 1C). One end portion of the folded dielectric body 20 is preferably a bonded portion 22. The first half and the second half of the lower surface of the dielectric body 20 facing each other are preferably non-bonded surfaces 23 and can slide relative to one another. In order to prevent opening of the dielectric layer 21 and the inhibition of sliding performance to be described later when the dielectric body 20 is bent, the non-bonded surfaces 23 may be partially bonded.

Figure 1D:
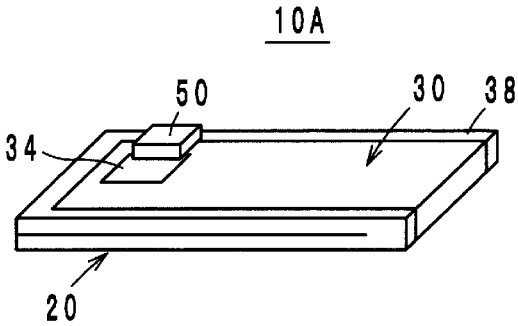
FIG. 1D is a perspective view of the wireless IC device in which a wireless IC element disposed on a radiator on the dielectric body.

Preferably, an opening 34 and a slit 35 are provided in the upper electrode 31, and the wireless IC element 50 is disposed at feeding portions 35*a* and 35*b* opposite the slit 35 (see, FIG. 1D). The wireless IC element 50 arranged to process a high-frequency signal will be described in detail later with reference to FIGS. 9 to 12. Preferably, a coupling between the wireless IC element 50 and the feeding portions 35*a* and 35*b* is achieved by electromagnetic field coupling or directly electrical coupling using solder bumps, for example.

In the wireless IC device 10A having the above-described configuration, when a predetermined high-frequency signal is transmitted from the wireless IC element 50 to the feeding portions 35*a* and 35*b*, current is concentrated around the opening 34. This current-concentrating portion functions as a loop magnetic field electrode having a predetermined length, and has a predetermined potential difference with respect to the feeding portions 35*a* and 35*b*. The predetermined potential difference of the loop magnetic field electrode is transmitted to the upper electrode 31. As a result, the upper electrode 31 has a potential difference with respect to the lower electrode 33 and operates as a patch antenna. Thus, a signal characteristic, for example, a wide-band frequency characteristic, supplied from the feeding portions 35*a* and 35*b* can be externally transmitted via the metal pattern 30. Where the metal pattern 30 externally receives a high-frequency signal, a current is similarly induced around the opening 34 and power is supplied from the feeding portions 35*a* and 35*b* to the wireless IC element 50. In this case, the loop magnetic field electrode performs impedance matching between the wireless IC element 50 and the metal pattern 30.

Figure 2A:
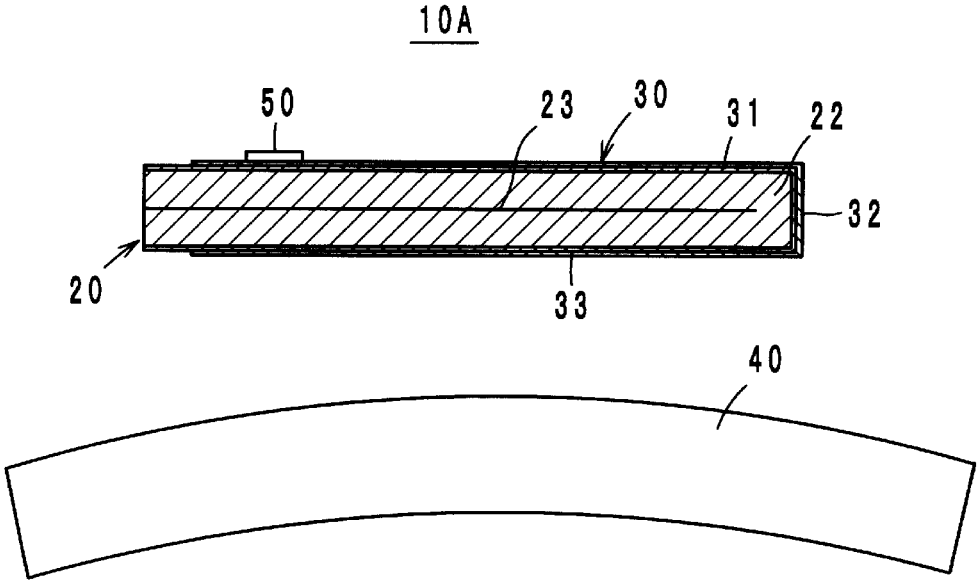
FIG. 2A is a cross-sectional view illustrating a wireless IC device according to the first preferred embodiment of the present invention and a product to which the wireless IC device is to be attached.
Figure 2B:
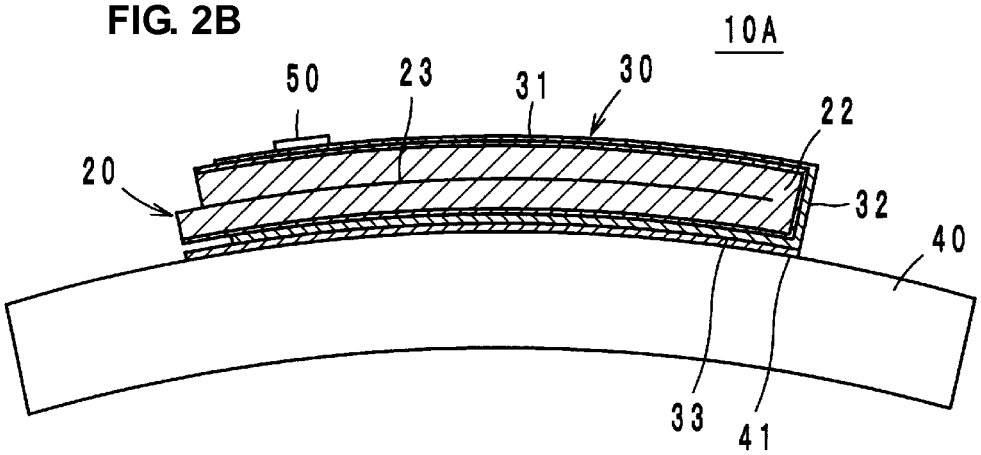
FIG. 2B is a cross-sectional view of the wireless IC device attached to the product.

Since an electromagnetic field radiated from the metal pattern 30 is relatively weak, only short-distance communication can be established. As illustrated in FIG. 2B, when the wireless IC device 10A is attached to a metal body 40 via an adhesive layer 41, the metal pattern 30 (the lower electrode 33) is capacitively coupled to the metal body 40 and the metal body 40 radiates a strong electromagnetic field from a surface thereof. In this case, the wireless IC device 10A can communicate with a reader/writer that is spaced apart from the wireless IC device 10A. A capacitor formed between the metal pattern 30 and the metal body 40 may be infinite. That is, the lower electrode 33 may be directly electrically connected to the metal body 40.

In the wireless IC device 10A, preferably, a radiator is defined by the metal pattern 30 that is flexible, and the dielectric body 20 is obtained by folding the dielectric layer 21 that is flexible and includes the non-bonded surfaces 23. Accordingly, even if the wireless IC device 10A is attached to the curved surface of the metal body 40 (for example, a gas cylinder), the dielectric body 20 and the metal pattern 30 follow the curved surface and the occurrence of stress concentration between the dielectric body 20 and the metal pattern 30 is prevented. As a result, a change in a communication characteristic caused by a detachment or distortion of the metal pattern 30 is prevented and communication reliability is not reduced.

In the first preferred embodiment, the width of the metal pattern 30 is preferably less than that of the dielectric body 20.

That is, the metal pattern 30 is preferably disposed inside ridge portions 20*a* and 20*b* of the dielectric body 20 (see, FIG. 1B). Therefore, the metal pattern 30 is prevented from being detached from the side surface of the dielectric body 20.

By disposing the metal pattern 30 on the flexible resin film 38 in advance, the wireless IC element 50 can preferably be disposed at the metal pattern 30 before the metal pattern 30 is attached to the dielectric body 20. This is an advantage in manufacturing a wireless IC device. The opening 34 and the slit 35 may not be provided in the upper electrode 31 of the metal pattern 30, and the upper electrode 31 may preferably be divided into two portions so as to obtain feeding portions and the feeding portions may be connected to the wireless IC element 50.

Second Preferred Embodiment

Figure 3A:
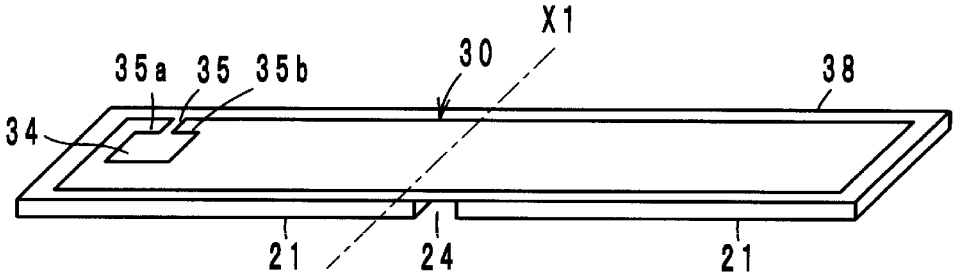
FIG. 3A is a perspective view of a dielectric body in a wireless IC device according to a second preferred embodiment of the present invention.
Figure 3B:
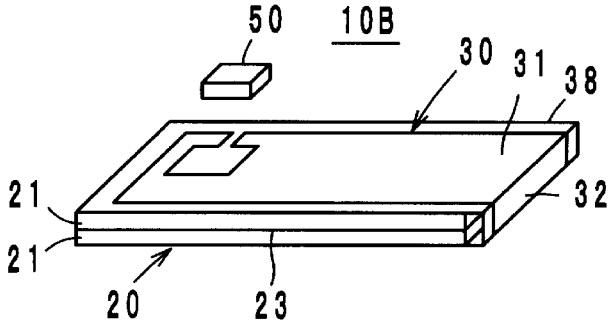
FIG. 3B is a perspective view of the folded dielectric body.

As illustrated in FIG. 3A, a wireless IC device 10B according to the second preferred embodiment of the present invention is preferably obtained by arranging two dielectric layers 21 with a distance 24 therebetween and disposing the metal pattern 30 on the dielectric layers 21 via the flexible resin film 38. By folding the flexible resin film 38 and the metal pattern 30 along an approximate center line (the line X1), the dielectric layers 21 face each other and the multilayer dielectric body 20 is obtained (see, FIG. 3B).

Figure 3C:
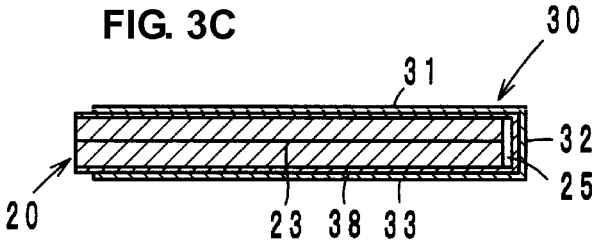
FIG. 3C is a cross-sectional view of the folded dielectric body.

In the second preferred embodiment, adjacent surfaces of the dielectric layers 21 in the lamination direction preferably define the non-bonded surfaces 23. The upper electrode 31 and the lower electrode 33 of the metal pattern 30 are preferably bonded to the upper surface and the lower surface of the dielectric body 20, respectively, via the flexible resin film 38. The side electrode 32 of the metal pattern 30 is preferably not bonded, and a gap 25 is provided (see, FIG. 3C). That is, the distance 24 illustrated in FIG. 3A is preferably greater than the total of thicknesses of the dielectric layers 21. When the dielectric layers 21 are folded along a line, the gap 25 is therefore provided at the line. Accordingly, when the wireless IC device 10B is attached to the curved surface of the metal body 40 and then the dielectric body 20 is bent, the gap 25 becomes slightly smaller. That is, the gap 25 absorbs tensile stress applied to the side electrode 32 when the dielectric body and the metal pattern 30 are bent. Only one of the upper electrode 31 and the lower electrode 33 may be bonded to the dielectric body 20.

Except for the above-described points, the configuration and operational effect according to the second preferred embodiment are substantially the same as those according to the first preferred embodiment. In the second preferred embodiment, in the dielectric body 20, the entire surfaces of the laminated dielectric layers 21 are preferably defined by non-bonded surfaces 23. However, one end portions of the dielectric layers 21 may be bonded.

Third Preferred Embodiment

Figure 4A:
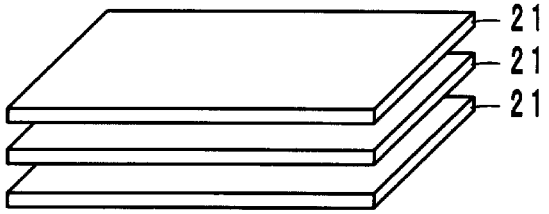
FIG. 4A is a perspective view of a dielectric body in a wireless IC device according to a third preferred embodiment of the present invention.
Figure 4B:
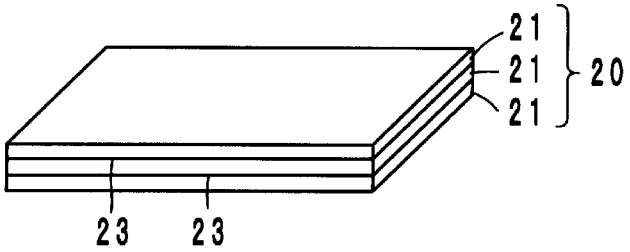
FIG. 4B is a perspective view of the dielectric body having a laminated structure.
Figure 4C:
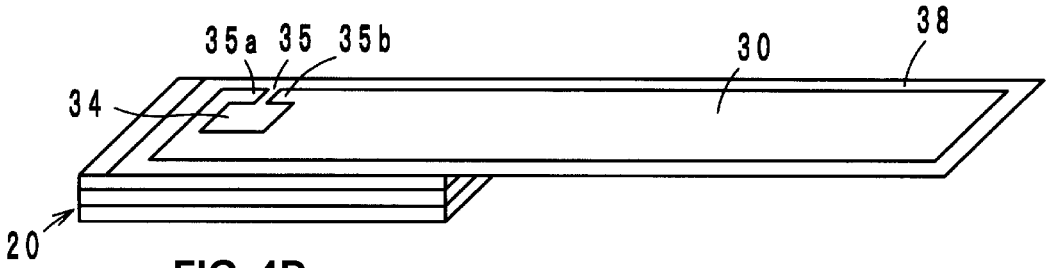
FIG. 4C is a perspective view illustrating the dielectric body and a metal pattern to be wound around the dielectric body.
Figure 4D:
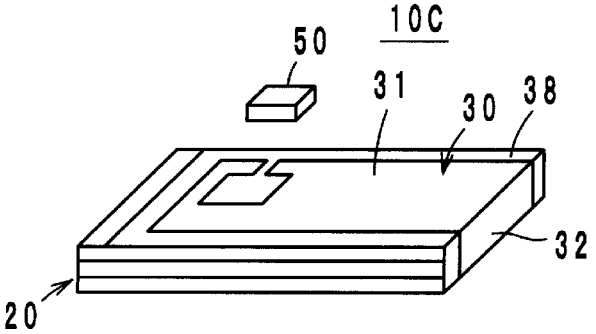
FIG. 4D is a perspective view of the wireless IC device in which the metal pattern is wound around the dielectric body.

The dielectric body 20 in a wireless IC device 10C according to the third preferred embodiment of the present invention is preferably obtained by laminating three dielectric layers 21, for example (see, FIGS. 4A and 4B). Here, surfaces of the three dielectric layers 21 facing each other preferably define the non-bonded surfaces 23. Preferably, by winding the flexible resin film 38 holding the metal pattern 30 around the dielectric body 20 from the upper surface to the lower surface via a side surface of the dielectric body 20 and disposing the wireless IC element 50 on the feeding portions 35*a* and 35*b*, the wireless IC device 10C is obtained.

Except for the above-described points, the configuration and operational effect according to the third preferred embodiment are substantially the same as those according to the first preferred embodiment. In particular, when the number of the non-bonded surfaces 23 is increased as described in the third preferred embodiment, the dielectric body can be easily bent even if the thickness of the dielectric body 20 is not changed.

Fourth Preferred Embodiment

Figure 5A:
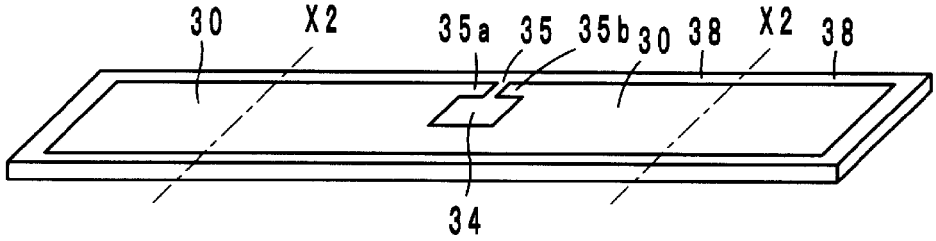
FIG. 5A is a perspective view of a dielectric body in a wireless IC device according to a fourth preferred embodiment of the present invention.
Figure 5B:
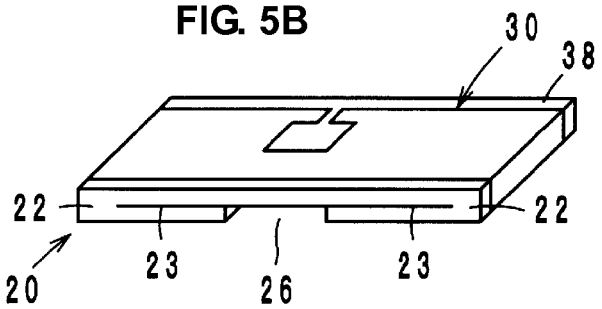
FIG. 5B is a perspective view of the folded dielectric body.

In a wireless IC device 10D according to the fourth preferred embodiment of the present invention, preferably, the opening 34 and the slit 35 of the metal pattern 30 defining a radiator are disposed at the approximate center of the upper electrode 31, and the upper electrode 31, a pair of the side electrodes 32, and the lower electrode 33 are arranged so as to encircle the dielectric body 20 (see, FIGS. 5A and 5B).

Figure 5C:
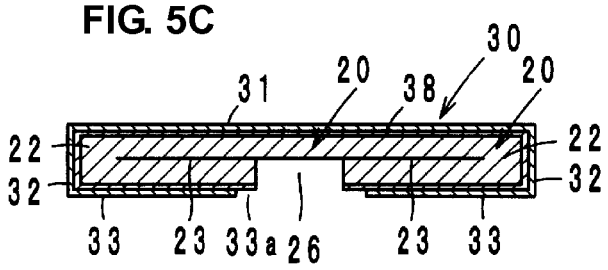
FIG. 5C is a cross-sectional view of the folded dielectric body.
Figure 5D:
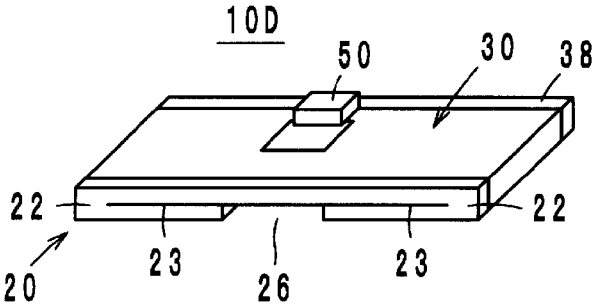
FIG. 5D is a perspective view of the wireless IC device in which a wireless IC element is disposed on a radiator on the dielectric body.

That is, in order to obtain the dielectric body 20, the flexible resin film 38 on which the metal pattern 30 is provided is preferably attached to the upper surface of a single dielectric layer 21 and the dielectric layer 21 is folded along lines (lines X2) spaced apart from both ends of the dielectric layer 21 by an approximately quarter of the length of the dielectric layer 21. As illustrated in FIGS. 5B and 5C, the dielectric body 20 preferably includes a gap 26 at the approximate center of the lower surface thereof, both ends of the dielectric body 20 define the bonded portions 22, and surfaces that face each other after the dielectric layer 21 has been folded preferably define the non-bonded surfaces 23.

Except for the above-described points, the configuration and operational effect according to the fourth preferred embodiment are substantially the same as those according to the first preferred embodiment. In particular, in the fourth preferred embodiment, preferably, the lower electrode 33 is divided into two portions by a slit 33*a*, is capacitively coupled to the metal body 40, and functions as a loop radiator.

Fifth Preferred Embodiment

Figure 6A:
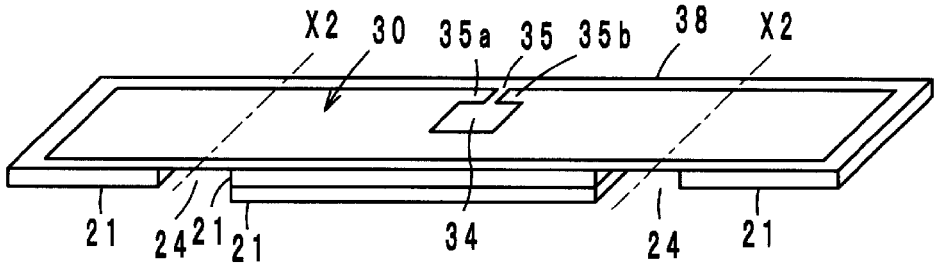
FIG. 6A is a perspective view of a dielectric body in a wireless IC device according to a fifth preferred embodiment of the present invention.
Figure 6B:
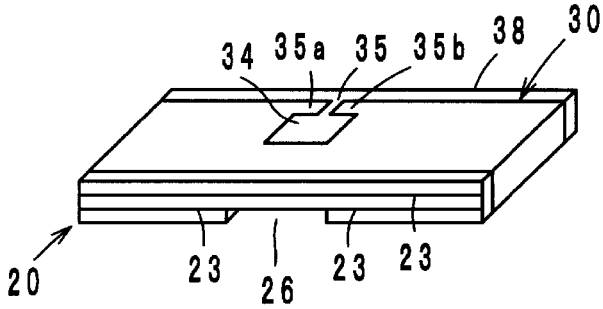
FIG. 6B is a perspective view of the folded dielectric body.
Figure 6C:
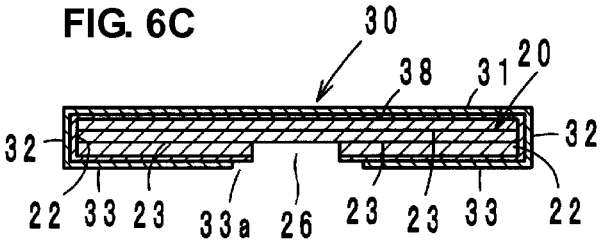
FIG. 6C is a cross-sectional view of the folded dielectric body.
Figure 6D:
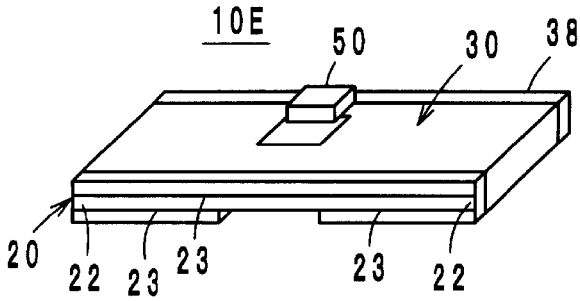
FIG. 6D is a perspective view of the wireless IC device in which a wireless IC element is disposed on a radiator on the dielectric body.

A wireless IC device 10E according to the fifth preferred embodiment of the present invention has a configuration similar to that described in the fourth preferred embodiment. The number of laminated dielectric layers in the dielectric body 20 is preferably increased to three, for example. As illustrated in FIG. 6A, the flexible resin film 38 on which the metal pattern 30 is provided is preferably attached to the upper surfaces of two laminated dielectric layers 21 arranged at the approximate center and two dielectric layers 21 arranged at both ends. Each of the distances 24 between the dielectric layers 21 is preferably substantially equal to the total of thicknesses of three dielectric layers 21. In order to obtain the dielectric body 20, the flexible resin film 38 and the dielectric layers 21 are folded along lines (the lines X2) at the distances 24. As illustrated in FIGS. 6C and 6D, preferably, the dielectric body includes the gap 26 at the approximate center of the lower surface thereof, both ends of the dielectric body 20 define the bonded portion 22, and surfaces that face each other after the flexible resin film 38 and the dielectric layers 21 have been folded define the non-bonded surfaces 23.

Except for the above-described points, the configuration and operational effect according to the fifth preferred embodiment are substantially the same as those according to the first preferred embodiment. In particular, in the fifth preferred embodiment, preferably, the lower electrode 33 is divided into two portions by the slit 33*a*, is capacitively coupled to the metal body 40, and functions as a loop radiator. Since the number of the non-bonded surfaces 23 is preferably relatively large, the dielectric body 20 can be easily bent as in the third preferred embodiment.

Sixth Preferred Embodiment

Figure 7:
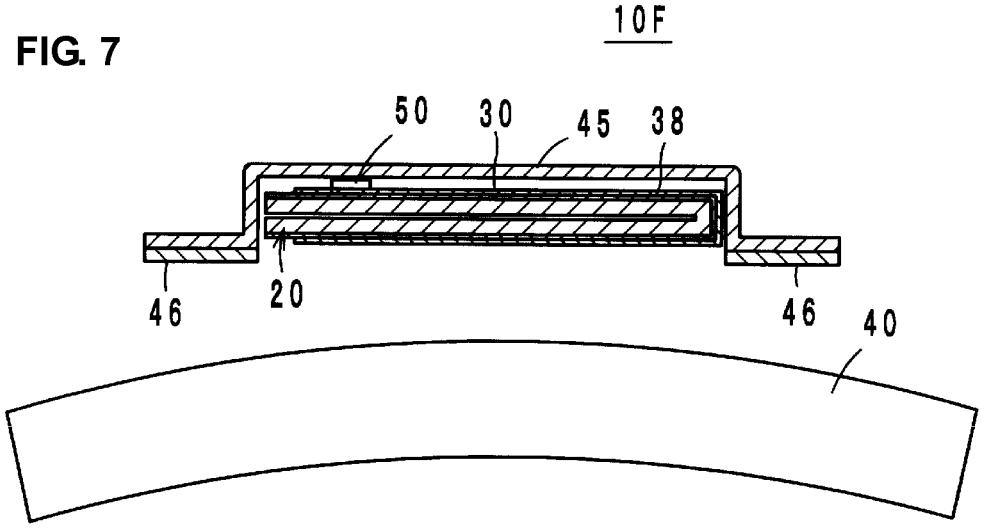
FIG. 7 is a cross-sectional view of a wireless IC device according to a sixth preferred embodiment of the present invention.

FIG. 7 illustrates a first exemplary preferred attachment of a wireless IC device 10F according to the sixth preferred embodiment of the present invention. The wireless IC device 10F preferably includes a protection cover 45 arranged to cover the dielectric body 20, the metal pattern 30, and the wireless IC element 50. The protection cover 45 is preferably attached to the metal body 40 with an adhesive 46 so that it covers the wireless IC device 10F attached to the metal body 40.

When the metal body 40 is a gas cylinder, it may be left outdoors or be handled roughly. In such a case, the protection cover 45 effectively protects the dielectric body 20 and the metal pattern 30 from the surrounding environment and from shock.

Seventh Preferred Embodiment

Figure 8:
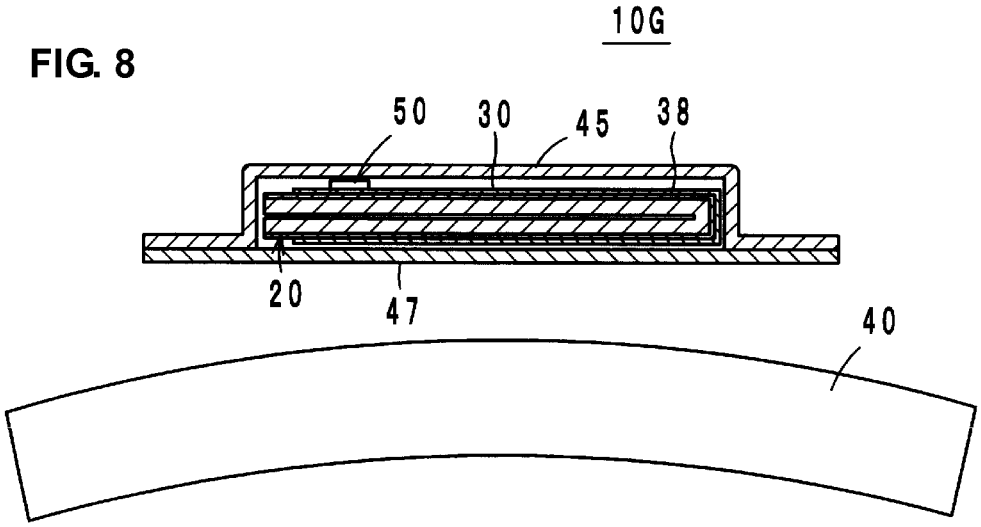
FIG. 8 is a cross-sectional view of a wireless IC device according to a seventh preferred embodiment of the present invention.

FIG. 8 illustrates a second exemplary preferred attachment of a wireless IC device 10G according to the seventh preferred embodiment of the present invention. In the wireless IC device 10G, a double-sided tape 47 is preferably arranged on the lower surface of the protection cover 45 described in the sixth preferred embodiment. The double-sided tape 47 is used to attach the wireless IC device 10G to the metal body 40 and protect the dielectric body 20 and the metal pattern 30 along with the protection cover 45. The double-sided tape 47 may be a film. In this case, the double-sided tape 47 is preferably bonded to the lower surface of the protection cover 45 and the metal body 40 with an adhesive.

Wireless IC Element

The wireless IC element 50 will be described below. Preferably, the wireless IC element 50 may be defined by a wireless IC chip 51 arranged to process a high-frequency signal as illustrated in FIG. 9, or may be defined by the wireless IC chip 51 and a feeding circuit board 65 including a resonance circuit having a predetermined resonance frequency as illustrated in FIG. 10.

Figure 9:
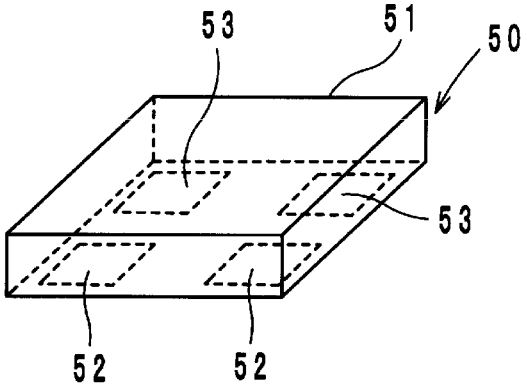
FIG. 9 is a perspective view of a wireless IC chip.

The wireless IC chip 51 illustrated in FIG. 9 preferably includes a clock circuit, a logic circuit, and a memory circuit, and stores necessary information. Input/output terminal electrodes 52 and mounting terminal electrodes 53 are preferably disposed on the lower surface of the wireless IC chip 51. The input/output terminal electrodes 52 are electrically connected to the feeding portions 35*a* and 35*b* via metal bumps. The metal bumps are preferably made of, for example, Au or solder.

Figure 10:
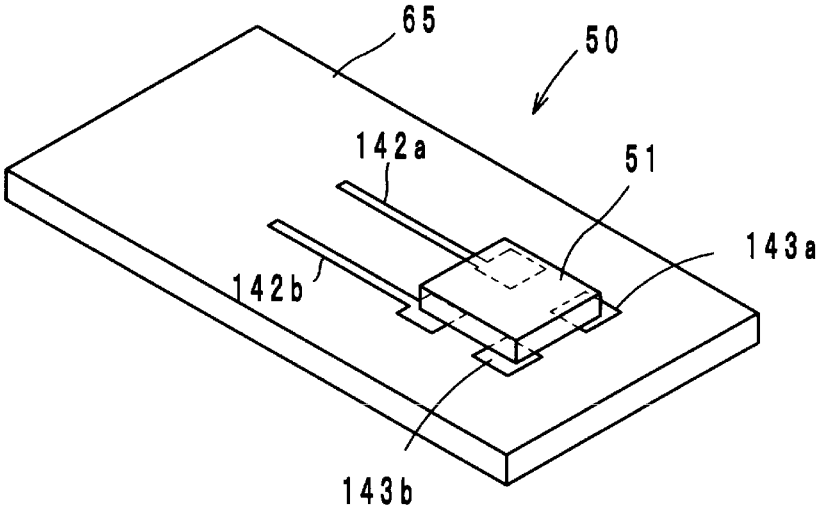
FIG. 10 is a perspective view of a feeding circuit board including the wireless IC chip thereon.
Figure 11:
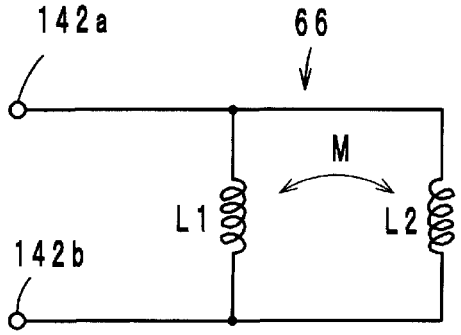
FIG. 11 is an equivalent circuit diagram illustrating an example of a feeding circuit.

When the wireless IC element 50 is defined by the wireless IC chip 51 and the feeding circuit board 65 as illustrated in FIG. 10, the feeding circuit board 65 may preferably include various feeding circuits (including a resonance/matching circuit). For example, as illustrated in an equivalent circuit diagram in FIG. 11, a feeding circuit 66 including inductance elements L1 and L2 that have different inductance values and opposite phases and are magnetically coupled to each other (represented by a mutual inductance M) may preferably be used. Preferably, the feeding circuit 66 has a predetermined resonance frequency, and performs impedance matching between the wireless IC chip 51 and the metal pattern 30. The wireless IC chip 51 and the feeding circuit 66 may be electrically connected or be connected via an electromagnetic field.

The feeding circuit 66 transmits a high-frequency signal of a predetermined frequency received from the wireless IC chip 51 to the above-described antenna and supplies a received high-frequency signal to the wireless IC chip 51 via the antenna. Since the feeding circuit 66 has a predetermined resonance frequency, it can easily perform impedance matching and the electrical length of an impedance matching circuit, that is, the loop metal pattern 30, can be reduced.

Next, the structure of the feeding circuit board 65 will be described. As illustrated in FIGS. 9 and 10, the input/output terminal electrodes 52 of the wireless IC chip 51 are connected to feeding terminal electrodes 142*a* and 142*b* provided on the feeding circuit board 65 via metal bumps, and the mounting terminal electrodes 53 of the wireless IC chip 51 are connected to mounting terminal electrodes 143*a* and 143*b* provided on the feeding circuit board 65 via metal bumps.

Figure 12:
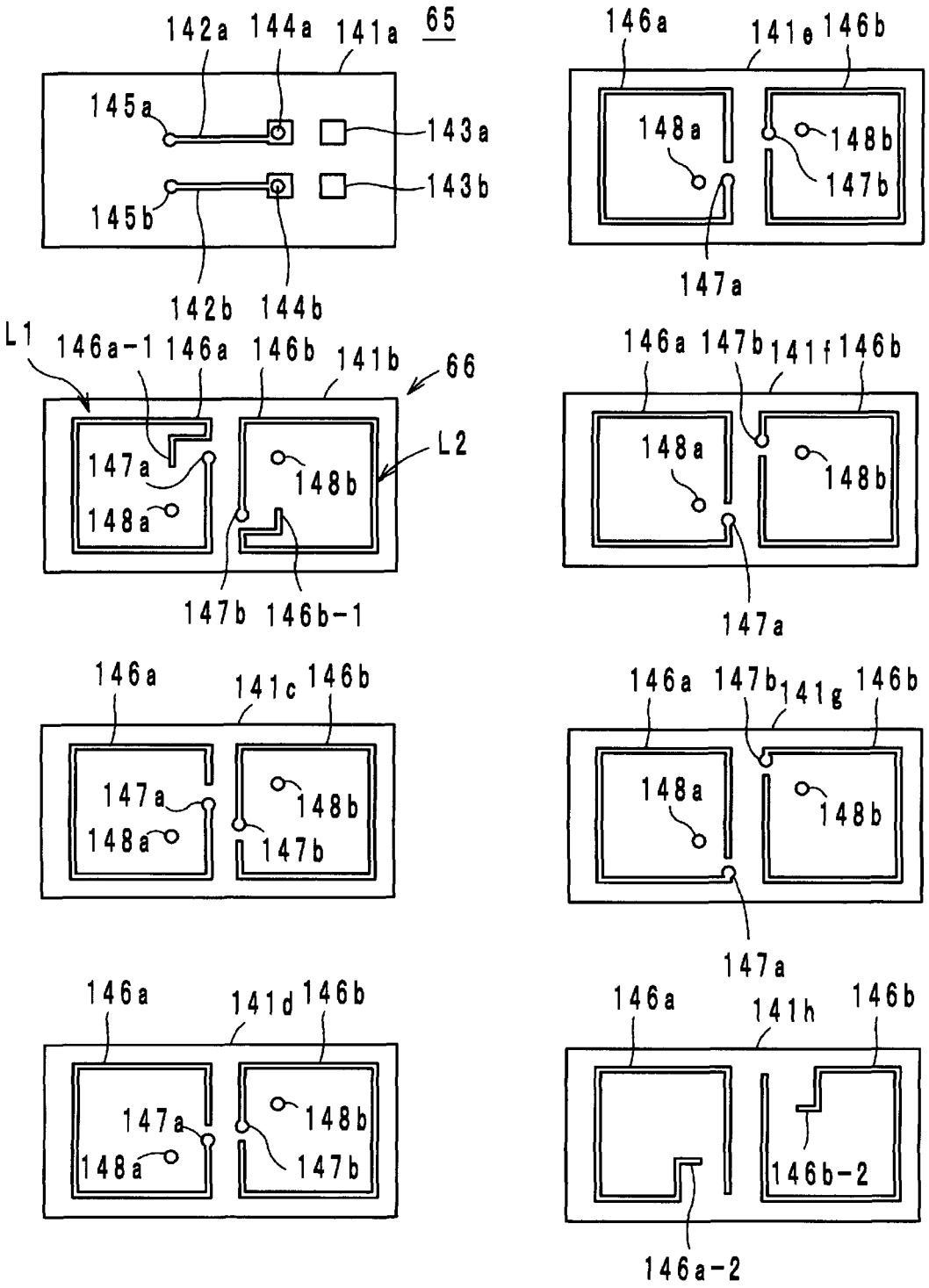
FIG. 12 is a plan view illustrating a laminated structure of the feeding circuit board.

As illustrated in FIG. 12, preferably, the feeding circuit board 65 is obtained by laminating, press-bonding, and firing ceramic sheets 141*a* to 141*h* each made of a dielectric or a magnetic substance, for example. Insulating layers included in the feeding circuit board 65 are not limited to ceramic sheets, and may be resin sheets made of a thermosetting resin such as liquid crystal polymer or a thermoplastic resin, for example. On the ceramic sheet 141*a* in the uppermost layer, the feeding terminal electrodes 142*a* and 142*b*, the mounting terminal electrodes 143*a* and 143*b*, and via-hole conductors 144*a*, 144*b*, 145*a*, and 145*b* are provided. The via-hole conductors 144*a* and 145*a* are connected to each other via the feeding terminal electrode 142*a*. The via-hole conductors 144*b* and 145*b* are connected to each other via the feeding terminal electrode 142*b*. On each of the ceramic sheets 141*b* to 141*h* in the second to eighth layers, a wiring electrode 146*a* forming the inductance element L1 and a wiring electrode 146*b* defining the inductance element L2 are formed and via-hole conductors 147*a*, 147*b*, 148*a*, and 148*b* are provided as required.

By laminating the ceramic sheets 141*a* to 141*h*, preferably, the inductance element L1 is defined by the wiring electrodes 146*a* that are helically connected to each other by the via-hole conductor 147*a* and the inductance element L2 is defined by the wiring electrodes 146*b* that are helically connected to each other by the via-hole conductor 147*b*. A capacitor is preferably defined between the wiring electrodes 146*a* and 146*b*.

An end portion 146*a*-1 of the wiring electrode 146*a* on the ceramic sheet 141*b* is connected to the feeding terminal electrode 142*a* via the via-hole conductor 145*a*. An end portion 146*a*-2 of the wiring electrode 146*a* on the ceramic sheet 141*h* is connected to the feeding terminal electrode 142*b* via the via-hole conductors 148*a* and 145*b*. An end portion 146*b*-1 of the wiring electrode 146*b* on the ceramic sheet 141*b* is connected to the feeding terminal electrode 142*b* via the via-hole conductor 144*b*. An end portion 146*b*-2 of the wiring electrode 146*b* on the ceramic sheet 141*h* is connected to the feeding terminal electrode 142*a* via the via-hole conductors 148*b* and 144*a*.

In the feeding circuit 66, since the inductance elements L1 and L2 are preferably wound in opposite directions, magnetic fields generated at the inductance elements L1 and L2 cancel each other out. Since the magnetic fields are cancelled, it is necessary to extend the wiring electrodes 146*a* and 146*b* so as to obtain desired inductances. When the lengths of the wiring electrodes 146*a* and 146*b* are increased, a Q value is reduced. As a result, the steepness of a resonance characteristic is eliminated and a wide band is obtained around a resonance frequency.

The inductance elements L1 and L2 are preferably arranged at different positions on the left and right sides in a perspective plan view of the feeding circuit board 65. The magnetic fields generated at the inductance elements L1 and L2 are preferably opposite in direction. As a result, when the feeding circuit 66 is coupled to an antenna, currents in opposite directions are excited at the antenna. Thus, a current can be generated at an adjacent metal plate, and the metal plate can operate as a radiating element (antenna) with a potential difference produced by the generated current.

By providing a resonance/matching circuit in the feeding circuit board 65, the resonance/matching circuit prevents a characteristic change caused by an external product and prevents deterioration in the quality of communication. By arranging the wireless IC chip 51 of the wireless IC element 50 at the approximate center of the feeding circuit board 65 in the thickness direction, it is possible to prevent the wireless IC chip 51 from being damaged or destroyed and increase the mechanical strength of the wireless IC element 50.

A wireless IC device according to preferred embodiments of the present invention is not limited to the above-described wireless IC devices. Various changes can be made to a wireless IC device according to preferred embodiments of the present invention without departing from the spirit and scope of the present invention.

In particular, a dielectric body may not be substantially rectangular parallelepiped and may be made of a thermosetting resin, for example, rubber, an elastomer, or an epoxy resin or a thermoplastic resin, for example, a polyimide. Alternatively, the dielectric body may be made of, for example, low-temperature co-fired ceramic (LTCC) on the condition that the dielectric body can have necessary flexible with non-bonded surfaces.

As described above, preferred embodiments of the present invention are useful for a wireless IC device, and, in particular, have an advantage in their suitability to prevent the detachment of a radiator from a body and to prevent a change in a communication characteristic even if a wireless IC device is attached to a curved surface.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A product comprising:

a body including a curved metal surface; and a wireless IC device attached to the curved metal surface; wherein the wireless IC device includes:

a dielectric body including an upper surface and a lower surface;

a radiator provided on the dielectric body; and a wireless IC element coupled to a feeding portion of the radiator;

the radiator is a metal pattern that is flexible;

the metal pattern extends from the upper surface of the dielectric body to the lower surface of the dielectric body;

the dielectric body has a laminated structure including a plurality of dielectric layers that are flexible, and adjacent ones of the plurality of dielectric layers in a lamination direction include non-bonded surfaces that slide relative to one another when the dielectric body is bent; and the radiator is bonded to the upper surface of the dielectric body with no gap therebetween and to the lower surface of the dielectric body with no gap therebetween, the radiator is not bonded to a side surface of the dielectric body extending between the upper surface and the lower surface, and a gap is provided between the radiator and the side surface of the dielectric body.

2. The product according to claim 1, wherein the radiator is arranged inside ridge portions of the dielectric body.

3. The product according to claim 1, wherein the dielectric body is obtained by folding at least one of the plurality of dielectric layers; and an inner surface obtained after the dielectric body has been folded defines the non-bonded surface.

4. The product according to claim 1, wherein at least portions of surfaces of adjacent ones of the plurality of dielectric layers in the lamination direction define the non-bonded surfaces.

5. The product according to claim 1, wherein the radiator extends continuously from the upper surface to the lower surface via the side surface of the dielectric body.

6. The product according to claim 1, wherein the radiator is provided on a film that is flexible.

7. The product according to claim 1, further comprising a protection member arranged to cover the dielectric body, the radiator, and the wireless IC element.

8. The product according to claim 1, wherein the wireless IC element is a wireless IC chip arranged to process a predetermined radio signal.

9. The product according to claim 8, wherein the wireless IC element includes the wireless IC chip and a feeding circuit board including a feeding circuit having a predetermined resonance frequency.

10. The product according to claim 1, wherein the radiator is provided on the dielectric body so as to extend continuously from the upper surface to the lower surface of the dielectric body.

11. A device product comprising:

a body including a curved metal surface; and a wireless IC device attached to the curved metal surface; wherein the wireless IC device includes:

a dielectric body including an upper surface and a lower surface;

a radiator provided on the dielectric body;

a wireless IC element coupled to a feeding portion of the radiator; and a protection member arranged to cover the dielectric body, the radiator, and the wireless IC element;

the radiator includes a metal pattern that is flexible;

the metal pattern extends from the upper surface of the dielectric body to the lower surface of the dielectric body;

the dielectric body has a laminated structure including a plurality of dielectric layers that are flexible, and adjacent ones of the plurality of dielectric layers in a lamination direction include non-bonded surfaces that slide relative to one another when the dielectric body is bent;

the dielectric body is covered by the protection member, is sealed by a film, and is attached to a surface of a metal body via the film; and the radiator is bonded to the upper surface of the dielectric body with no gap therebetween and to the lower surface of the dielectric body with no gap therebetween, the radiator is not bonded to a side surface of the dielectric body extending between the upper surface and the lower surface, and a gap is provided between the radiator and the side surface of the dielectric body.

12. The product according to claim 11, wherein the radiator is provided on the dielectric body so as to extend continuously from the upper surface to the lower surface of the dielectric body.

* * * * *